US009986352B2

(12) United States Patent
Fujita et al.

(10) Patent No.: US 9,986,352 B2
(45) Date of Patent: May 29, 2018

(54) ACOUSTIC PROCESSING DEVICE, ACOUSTIC PROCESSING METHOD, AND ACOUSTIC PROCESSING PROGRAM

(71) Applicant: Clarion Co., Ltd., Saitama-shi (JP)

(72) Inventors: Yasuhiro Fujita, Kashiwa (JP); Takeshi Hashimoto, Motomiya (JP); Tetsuo Watanabe, Hasuda (JP); Kazutomo Fukue, Saitama (JP)

(73) Assignee: CLARION CO., LTD., Saitama (JP)

( * ) Notice: Subject to any disclaimer, the term of this patent is extended or adjusted under 35 U.S.C. 154(b) by 0 days. days.

(21) Appl. No.: 15/118,930

(22) PCT Filed: Feb. 4, 2015

(86) PCT No.: PCT/JP2015/053028
§ 371 (c)(1),
(2) Date: Aug. 15, 2016

(87) PCT Pub. No.: WO2015/122324
PCT Pub. Date: Aug. 20, 2015

(65) Prior Publication Data

US 2016/0360330 A1 Dec. 8, 2016

(30) Foreign Application Priority Data

Feb. 17, 2014 (JP) ..... 2014-027213

(51) Int. Cl.
*H04R 29/00* (2006.01)
*H04R 3/04* (2006.01)
*H04R 3/00* (2006.01)

(52) U.S. Cl.
CPC ..... *H04R 29/001* (2013.01); *H04R 3/04* (2013.01); *H04R 3/007* (2013.01); *H04R 2227/007* (2013.01); *H04R 2499/13* (2013.01)

(58) Field of Classification Search
None
See application file for complete search history.

(56) References Cited

U.S. PATENT DOCUMENTS 9,280,986 B2 3/2016 Hashimoto
2003/0187636 A1* 10/2003 Klippel ..... H04R 29/001 704/220

(Continued)

FOREIGN PATENT DOCUMENTS

EP 2827330 A1 1/2015
JP H04299398 10/1992

(Continued)

OTHER PUBLICATIONS

International Search Report issued in PCT/JP2015/053028 dated Apr. 4, 2015.

(Continued)

*Primary Examiner* — Curtis Kuntz
*Assistant Examiner* — Kenny Truong
(74) *Attorney, Agent, or Firm* — McCarter & English, LLP

(57) ABSTRACT

An acoustic processing device comprises: a resonant band detecting means that detects a resonant band of sound output from a speaker based on a measurement result of a predetermined measurement signal reproduced through the speaker; an analyzing means that analyzes the measurement result of the predetermined measurement signal; a control parameter generating means that generates a control parameter for controlling the resonant band detected by the resonant band detecting means based on an analysis result by the analyzing means; and an audio signal controlling means that controls an audio signal input from a predetermined audio signal reproducing device based on the control parameter generated by the control parameter generating means such (Continued)

that a resonant band component of reproduced sound of the audio signal is suppressed to be short on a time axis.

10 Claims, 15 Drawing Sheets

(56) References Cited

U.S. PATENT DOCUMENTS

| | | | | |
|---|---|---|---|---|
| 2006/0115095 | A1 | 6/2006 | Giesbrecht et al. | |
| 2007/0253561 | A1 | 11/2007 | Williams et al. | |
| 2010/0329481 | A1* | 12/2010 | Fukuda | H04R 1/1083 381/94.1 |
| 2012/0106750 | A1* | 5/2012 | Thormundsson | H04R 3/007 381/71.12 |
| 2012/0230514 | A1* | 9/2012 | Yoneda | H04R 3/04 381/96 |
| 2013/0142360 | A1 | 6/2013 | Potard | |
| 2015/0003017 | A1 | 1/2015 | Hashimoto | |
| 2015/0030171 | A1 | 1/2015 | Hashimoto | |

FOREIGN PATENT DOCUMENTS

| | | |
|---|---|---|
| JP | 2005022546 | 1/2005 |
| JP | 2011134412 | 7/2011 |
| JP | 2013190470 | 9/2013 |
| JP | 2013207689 | 10/2013 |
| WO | 2015/122324 | 8/2015 |

OTHER PUBLICATIONS

Angelo Farina: "Simultaneous Measurement of Impulse Response and Distortion with a Swept-Sine Technique", 108TH AES Convention Feb. 2000, Feb. 19, 2000 (Feb. 19, 2000), XP055401242, Paris, France *pp. 1,5-p. 6 * * p. 10-p. 11; figures 5,7, 20.

Naoya Moriya et al: "Study of harmonic distortion on impulse response measurement with logarithmic time stretched pulse". Acoustical Science and Technology. vol. 26. No. 5. Apr. 19, 2005 (Apr. 19, 2005) pp. 462-464. XP055401385. JPISSN: 1346-3969. DOI: 10.1250/ast.26.462* p. 462; figures 2-5 *.

Extended European Search Report and Written Opinion issued for Application No. EP15749495 dated Sep. 7, 2017.

* cited by examiner (a)

(b)

(c)

ACOUSTIC PROCESSING DEVICE, ACOUSTIC PROCESSING METHOD, AND ACOUSTIC PROCESSING PROGRAM

This application is a National Phase Application of PCT International Application No.: PCT/JP2015/053028, filed on Feb. 4, 2015.

TECHNICAL FIELD

The present invention relates an acoustic processing device, an acoustic processing method and an acoustic processing program.

BACKGROUND ART

An in-vehicle speaker attached to a ceiling base material of an vehicle is known (see, for example. Japanese Patent Provisional Publication No. 2005-22546A hereafter referred to as "patent document 1"). The in-vehicle speaker of this type is configured such that a body part thereof attached to a ceiling base material functions as a vibrator, and sound is output by letting interior material, such as a ceiling material and a door trim, vibrate as a vibrating plate.

SUMMARY OF THE INVENTION

Since the speaker described as an example in the patent document 1 is configured to transmit sound by vibration of the body part, vibration of the body part changes depending on an input level of an audio signal. As the audio signal gets larger, vibration becomes larger particularly when a low band is reproduced. At this time, a possibility arises that not only abnormal sound is generated by excessive vibrating sound, but also distorted sound (resonant sound) is generated by resonance caused in an attaching portion of the speaker and peripheral components of the speaker. Frequency bands in which this type of resonant sound is generated differ in regard to an attaching method and/or an attaching position of the speaker, the type of a vehicle and the like.

A concrete example of an acoustic device for reducing frequency bands in which resonant sound is generated is described in Japanese Patent Provisional Publication No. 2013-207689A (hereafter, referred to as "patent document 2"). The acoustic device described in the patent document 2 is configured to detect a frequency band in which resonant sound is generated from a frequency characteristic of harmonic distortion of a current flowing through a speaker, and to lower a gain of the detected frequency band. Indeed, the resonant sound can be reduced by lowering the gain of the frequency band in which the resonant sound is generated. However, occurrence of a defect that sound pressure is also reduced together with the resonant sound is inevitable. Furthermore, the frequency characteristic of harmonic distortion of a current flowing through a speaker merely provides detection of a characteristic (distortion and resonance) of the speaker itself. That is, the configuration described in the patent document 2 is not able to precisely detect a frequency band of resonant sound which fluctuates depending on a listening environment (e.g., various types of factors including an attaching method and/or an attaching position of a speaker, the type of a vehicle, and resonance of peripheral components). Therefore, it is not possible to suitably suppress resonant sound generated in a certain listening environment.

The present invention is made in view of the above described circumstance, and the object of the invention is to provide an acoustic processing device, an acoustic processing method and an acoustic processing program capable of suitably suppressing resonant sound generated in a certain listening environment without lowering sound pressure.

An acoustic processing device according to an embodiment of the invention comprises: a resonant band detecting means that detects a resonant band of sound output from a speaker based on a measurement result of a predetermined measurement signal reproduced through the speaker; an analyzing means that analyzes the measurement result of the predetermined measurement signal; a control parameter generating means that generates a control parameter for controlling the resonant band detected by the resonant band detecting means based on an analysis result by the analyzing means; and an audio signal controlling means that controls an audio signal input from a predetermined audio signal reproducing device based on the control parameter generated by the control parameter generating means such that a resonant band component of reproduced sound of the audio signal is suppressed to be short on a time axis.

An acoustic processing device according to an embodiment of the invention comprises: a resonant band detecting means that detects a resonant band of sound output from a speaker based on a measurement result of a predetermined measurement signal reproduced through the speaker; an analyzing means that analyzes the measurement result of the predetermined measurement signal of each input level; a control parameter generating means that generates a control parameter for controlling the resonant band detected by the resonant band detecting means based on an analysis result by the analyzing means, the control parameter being generated for each input level of the predetermined measurement signal; a control parameter storing means that stores the control parameter generated for each input level by the control parameter generating means; and an audio signal controlling means that selects, from the control parameter storing means, the control parameter corresponding to an input level of an audio signal input from a predetermined audio signal reproducing device and controls the audio signal based on the selected control parameter such that a resonant band component of reproduced sound of the audio signal is suppressed to be short on a time axis.

The predetermined measurement signal includes, for example, a predetermined sweep signal. In this case, the resonant band detecting means is configured to: detect a speaker distortion characteristic using a reference signal of the predetermined sweep signal and the measurement result of the predetermined sweep signal; and detect the resonant band based on the detected speaker distortion characteristic.

The predetermined measurement signal may include an TSP (Time Stretched Pulse) signal. In this case, the analyzing means is configured to calculate an impulse response of a listening environment using a reference signal of the TSP signal and the measurement result of the TSP signal, and to analyze the measurement result based on the calculated impulse response.

The control parameter includes, for example, a control gain for controlling a gain of the resonant band and a control time for controlling a reverberation time of the resonant band.

The resonant band detecting means may be configured to detect the speaker distortion characteristic using the reference signal of the predetermined sweep signal and the measurement result of the predetermined sweep signal for each input level. In this case, the control parameter generating means is configured to: set, for each resonant band, a predetermined reference input level based on the speaker distortion characteristic of each input level; and calculate, for each resonant band, the control gain based on a ratio between an attenuation inclination of a speaker response characteristic at an input level of the predetermined measurement signal and an attenuation inclination of a speaker response characteristic at the reference input level. The control parameter generating means may be configured to calculate, for each resonant band, the control time based on a ratio between the reverberation time at the input level of the predetermined measurement signal and the reverberation time at the reference input level.

An acoustic processing method according to an embodiment of the invention comprises: a resonant band detecting step of detecting a resonant band of sound output from a speaker based on a measurement result of a predetermined measurement signal reproduced through the speaker; an analyzing step of analyzing the measurement result of the predetermined measurement signal; a control parameter generating step of generating a control parameter for controlling the resonant band detected by the resonant band detecting step based on an analysis result by the analyzing step; and an audio signal controlling step of controlling an audio signal input from a predetermined audio signal reproducing device based on the control parameter generated by the control parameter generating step such that a resonant band component of reproduced sound of the audio signal is suppressed to be short on a time axis.

An acoustic processing method according to an embodiment of the invention comprises: a resonant band detecting step of detecting a resonant band of sound output from a speaker based on a measurement result of a predetermined measurement signal reproduced through the speaker; an analyzing step of analyzing the measurement result of the predetermined measurement signal of each input level; a control parameter generating step of generating a control parameter for controlling the resonant band detected by the resonant band detecting step based on an analysis result by the analyzing step, the control parameter being generated for each input level of the predetermined measurement signal; a control parameter storing step of storing, in a predetermined storage medium, the control parameter generated for each input level by the control parameter generating step; and an audio signal controlling step of selecting, from control parameters stored in the predetermined storage medium, the control parameter corresponding to an input level of an audio signal input from a predetermined audio signal reproducing device and controlling the audio signal based on the selected control parameter such that a resonant band component of reproduced sound of the audio signal is suppressed to be short on a time axis.

An acoustic processing program according to an embodiment of the invention is a program for causing a computer to execute the above described acoustic processing method.

According to the embodiments of the invention, an acoustic processing device, an acoustic processing method and an acoustic processing program capable of suitably suppressing resonant sound generated in a certain listening environment without lowering sound pressure are provided.

EMBODIMENTS FOR CARRYING OUT THE INVENTION

In the following, an embodiment of the invention is described with reference to the accompanying drawings. In the following explanation, an acoustic processing device having a speaker embedded in a door trim in a vehicle compartment is described by way of example.

(Configuration of Acoustic Processing Device 1)

As an input level of an audio signal increases, vibration of a speaker itself gets greater and thereby a mounting portion of the speaker and peripheral components of the speaker resonate. Since, in this case, a speaker response gets longer, resonant sound is produced. For this reason the acoustic processing device according to the embodiment obtains a distortion characteristic and an impulse response of a speaker by measuring a speaker response characteristic at each input level. The acoustic processing device according to the embodiment detects, based on the obtained distortion characteristic, a frequency band (hereafter referred to as a "resonant band") in which resonant sound is produced, and generates control parameters for controlling a response of the speaker based on cumulative spectral decay obtained from the detected resonant band and the impulse response.

The acoustic processing device according to the embodiment performs response control of the speaker in accordance with an input level of an audio signal using the generated control parameters. As a result, it becomes possible to suitably suppress the resonant sound produced in a vehicle compartment being a listening environment without decreasing sound pressure.

Processing by an acoustic processing device 1 explained below is executed under cooperation between software and hardware provided in the acoustic processing device 1. At least an OS (Operating System) part of the software in the acoustic processing device 1 is provided as an embedded system; however, the other part of the software, e.g., a software module for generating control parameters and executing response control of a speaker responsive to an input level of an audio signal using the generated control parameters, may be provided as an application which can be distributed over a network.

(Measurement of Reproduced Sound at Each Input Level)

Figure 1:
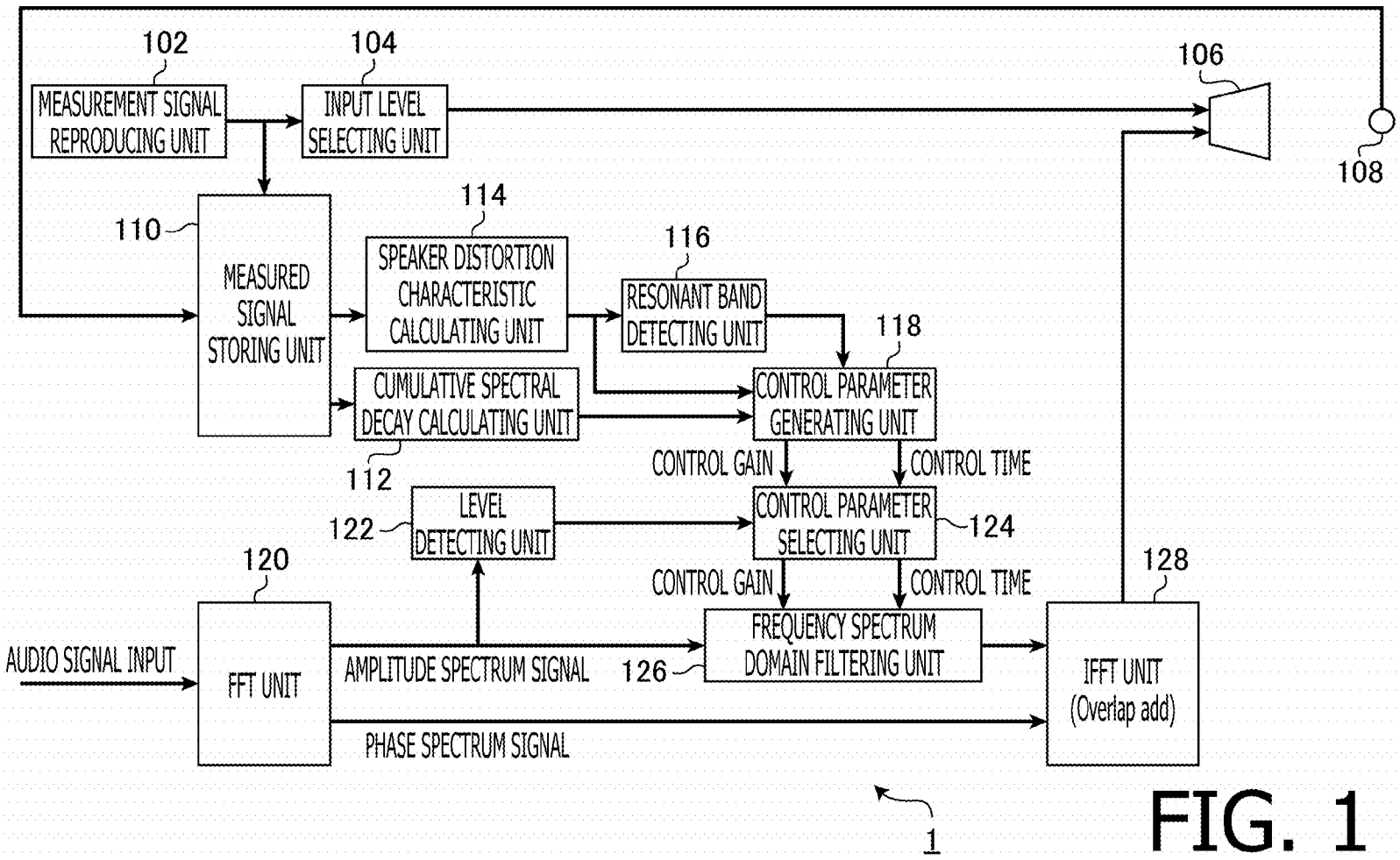
FIG. 1 is a block diagram illustrating a configuration of an acoustic processing device according to an embodiment of the invention.

FIG. 1 is a block diagram illustrating a configuration of the acoustic processing device 1 according to the embodiment. As shown in FIG. 1, the acoustic processing device 1 includes a measurement signal reproducing unit 102, an input level selecting unit 104, a speaker 106, a microphone 108 and a measured signal storing unit 110.

The measurement signal reproducing unit 102 outputs a sweep signal and a TSP (Time Stretched Pulse) signal as measurement signals. The sweep signal is generated by sweeping a sine wave within a range of 40 Hz to 300 Hz. The TSP signal is a signal of which phase of a pulse signal is proportional to the square of frequency. The input level selecting unit 104 changes the level of the sweep signal and the TSP signal input from the measurement signal reproducing unit 102.

The speaker 106 reproduces sound of the sweep signal and the TSP signal of which the input level has been changed by the input level selecting unit 104. The measured signal storing unit 110 stores the reproduced sound acquired by the microphone 108 as measurement results (hereafter, referred to as "measured sweep signal" and "measured TSP signal", respectively), and stores the sweep signal and the TSP signal input from the measurement signal reproducing unit 102 as references to the stored measurement results. In the measured signal storing unit 110, the measurement results at respective input levels (i.e., the measurement results corresponding to respective input levels) changed by the input level selecting unit 104 are stored. The input level selecting unit 104 changes the input level at intervals of 2 dB within the range of 0 dB to −20 dB.

(Calculation of Cumulative Spectral Decay)

As shown in FIG. 1, the acoustic processing device 1 includes a cumulative spectral decay calculating unit 112. The cumulative spectral decay calculating unit 112 calculates an impulse response between the speaker 106 and the microphone 108 using the reference TSP signal and the measured TSP signal stored in the measured signal storing unit 110. The impulse response is obtained by subjecting the measured TSP signal and the inverse property of the reference TSP signal to the Fourier transform to multiply them together in the frequency domain, and by performing the inverse Fourier transform for the multiplied values. The cumulative spectral decay calculating unit 112 analyzes the impulse response obtained at each input level, and calculates the cumulative spectral decay for each input level.

It should be noted that conventionally cumulative spectral decay has been used for the cumulative spectral decay method for observing a characteristic of a speaker. The cumulative spectral decay method has been proposed by Fincham at al, of KEF in United Kingdom as a time frequency analysis method for evaluating a transient characteristic of a speaker system. According to the cumulative spectral decay method, an impulse response waveform measured between a speaker and a microphone is analyzed, and change of the frequency characteristic with respect to a time-lapse can be recognized based on the analysis result.

Figure 2:
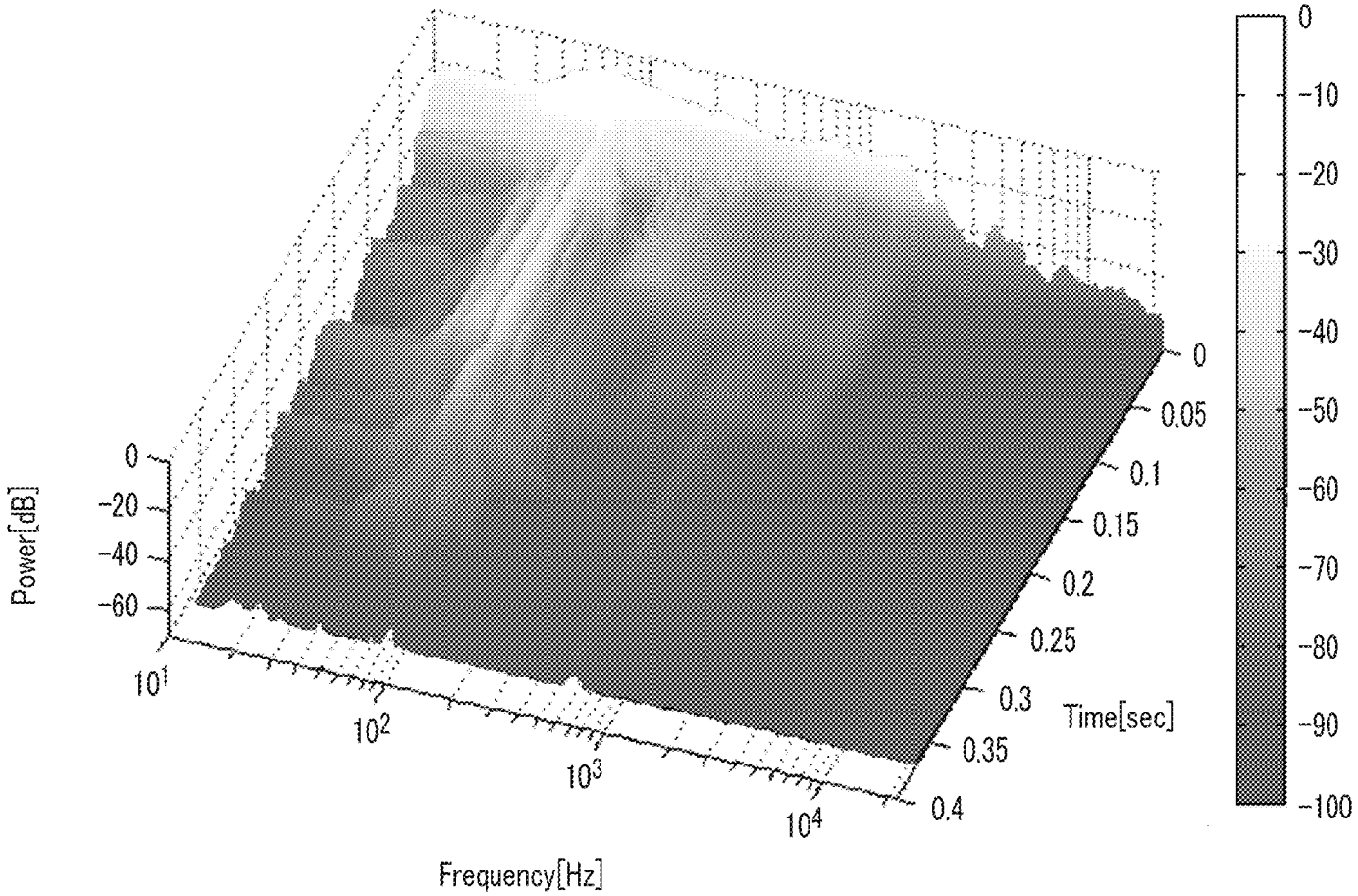
FIG. 2 is a diagram illustrating cumulative spectral decay at an input level of 0 dB.

FIG. 2 is a diagram illustrating the cumulative spectral decay at the input level of 0 dB. As shown in FIG. 2, the cumulative spectral decay has three axes of an amplitude level (power) (unit: dB), frequency (unit: Hz) and time (unit: sec). Power is the square of the amplitude. The human auditory characteristic is logarithmic with respect to the frequency. The frequency of the lateral axis is represented in logarithm to comply with the human auditory characteristic.

The speaker 106 is embedded in a door trim in a vehicle compartment. Therefore, as the input level gets higher, the time in which the speaker 106 vibrates the peripheral parts thereof gets longer. Referring to the cumulative spectral decay shown in FIG. 2, it can be seen that the response characteristic of the speaker is long at a relatively low frequency band around 100 Hz, and resonance is caused at around 100 Hz.

(Detection of Resonant Band at Each Input Level)

As shown in FIG. 1, the acoustic processing device 1 includes a speaker distortion characteristic calculating unit 114 and a resonant band detecting unit 116. The speaker distortion characteristic calculating unit 114 calculates the speaker distortion characteristic at each input level using the reference sweep signal and the measured sweep signal stored in the measured signal storing unit 110. Specifically, the speaker distortion characteristic calculating unit 114 subtracts the reference sweep signal from the measured sweep signal for each input level. As a result, components other than the sin wave (harmonic distortion and noise) can be obtained, and the speaker distortion characteristic at each input level can be obtained. The speaker distortion characteristic means a ratio (unit: %) indicating how much undesirable components (harmonic distortion and noise) are contained with respect to the component of the reference wave (the measured sweep signal).

Figure 3:
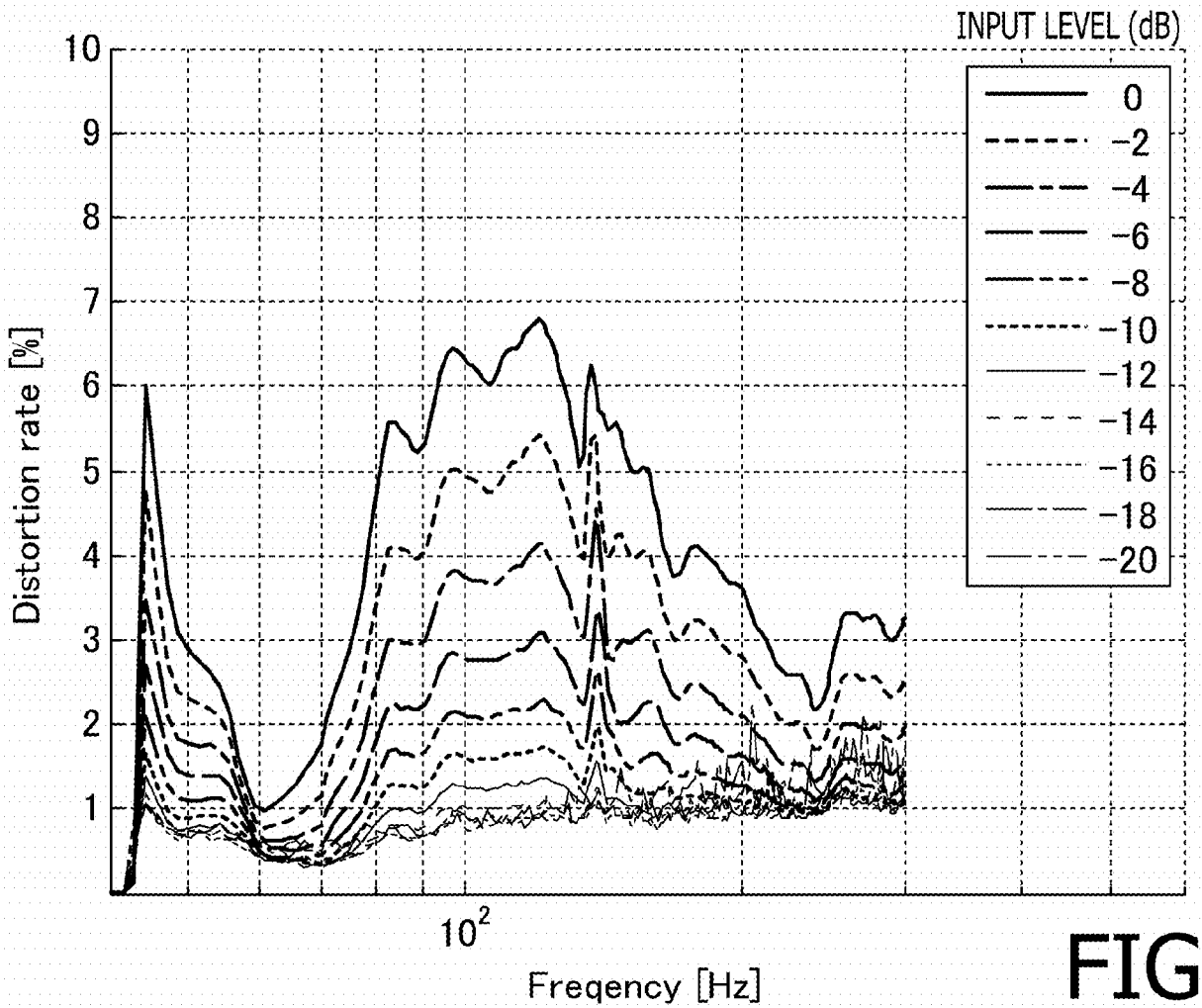
FIG. 3 is a diagram illustrating a speaker distortion characteristic at each input level (levels at intervals of 2 dB within the range of 0 dB to −20 dB).

FIG. 3 is a diagram illustrating the speaker distortion characteristic at each input level (levels at intervals of 2 dB within the range of 0 dB to −20 dB). In FIG. 3, the vertical axis represents the speaker distortion (Distortion Rate (unit %)), and the lateral axis represents the frequency (unit: Hz).

The resonant band detecting unit 116 detects the resonant band at each input level based on the speaker distortion characteristic calculated by the speaker distortion characteristic calculating unit 114. As an example, by comparing the cumulative spectral decay shown in FIG. 2 and the graph at the input level of 0 dB in FIG. 3, it can be seen that as the speaker distortion rate gets higher, the resonance gets greater and the speaker response characteristic gets longer. Therefore, the resonant band detecting unit 116 detects, as the resonant band, the frequency band of which speaker distortion rate is higher than a first threshold. It is said that, in general, a listener perceives distortion at the speaker distortion rate of 3% to 5%. For this reason, in this embodiment, the first threshold is set to 3%. In the example shown in FIG. 3, a region around 45 Hz to 50 Hz, a region around 75 Hz to 210 Hz and a region around 250 Hz to 300 Hz are detected as the resonant bands.

(Generating of Control Parameter (Control Gain and Control Time))

Figure 4:
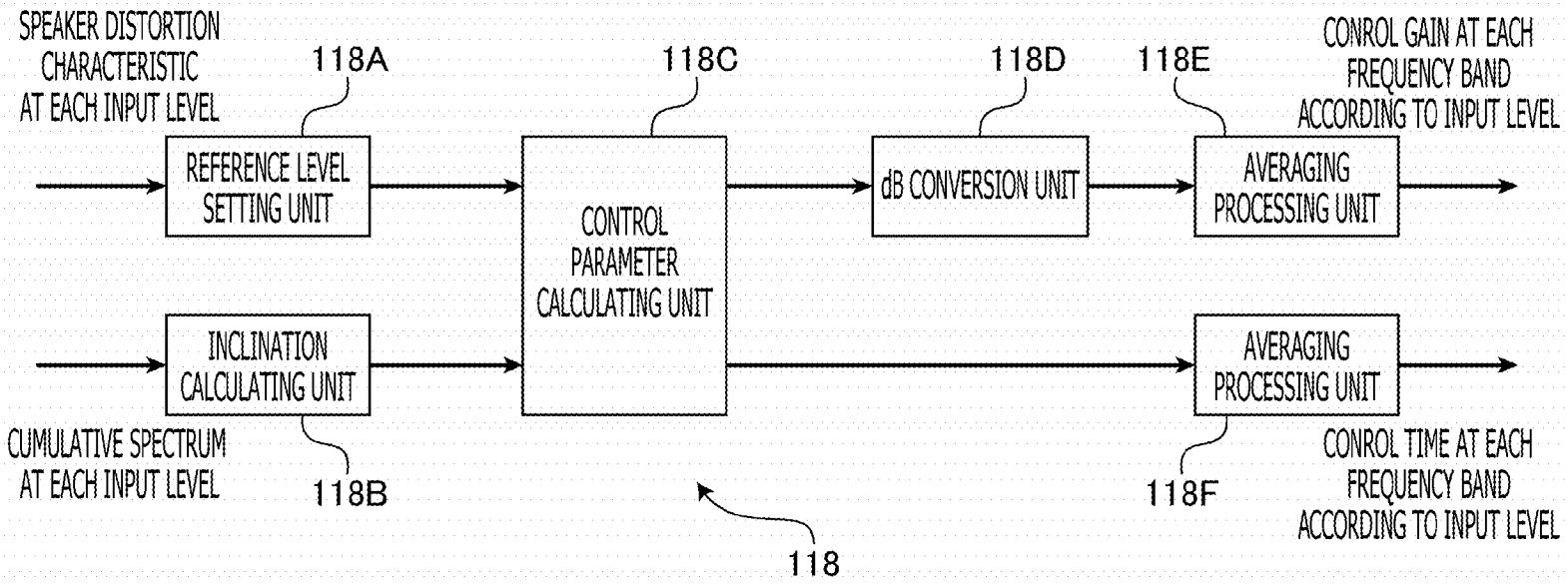
FIG. 4 is a block diagram illustrating a configuration of a control parameter generating unit provided in the acoustic processing device according to the embodiment of the invention.

As shown in FIG. 1, the acoustic processing device 1 includes a control parameter generating unit 118. FIG. 4 is a block diagram illustrating a configuration of the control parameter generating unit 118. As shown in FIG. 4, the control parameter generating unit 118 includes a reference level setting unit 118A, an inclination calculating unit 118B, a control parameter calculating unit 118C, a dB conversion unit 118D and averaging processing units 118E and 118F. The control parameter generating unit 118 calculates control parameters (a control gain and a control time) for controlling a response of a speaker when the speaker distortion rate calculated by the speaker distortion characteristic calculating unit 114 exceeds a second threshold.

The reference level setting unit 118A sets, as the reference input level an input level of which the speaker distortion rate is smaller than or equal to the second threshold, within the resonant band detected by the resonant band detecting unit 116, based on the speaker distortion characteristic calculated by the speaker distortion characteristic calculating unit 114. The second threshold has a value smaller than or equal to the first threshold, and a user is allowed to desirably set the value of the second threshold (1.5% in this embodiment) through a user operation.

Setting of the reference input level is explained below with reference to FIG. 3. Considering, for example, the frequency of 100 Hz detected as the resonant band at the input level of 0 dB, the speaker distortion rate at the 100 Hz becomes smaller than or equal to the second threshold (1.5%) at the input level of −10 dB. Therefore, regarding the input levels (0 dB, −2 dB, 04 dB, −6 dB, and −8 dB) of which the speaker distortion rates exceed the second threshold, −10 dB is set as the reference input level with respect to each of the input levels (0 dB, −2 dB, 04 dB, −6 dB, and −8 dB). When the input level is smaller than or equal to −10 dB, the speaker distortion rate is smaller than or equal to the second threshold. Therefore, for the input levels smaller than or equal to −10 dB, no reference level is set. After such a process is executed for the respective input levels at the respective resonant frequencies, the reference levels are set (or not set) for the respective input levels for each of the resonant bands.

Figure 5:
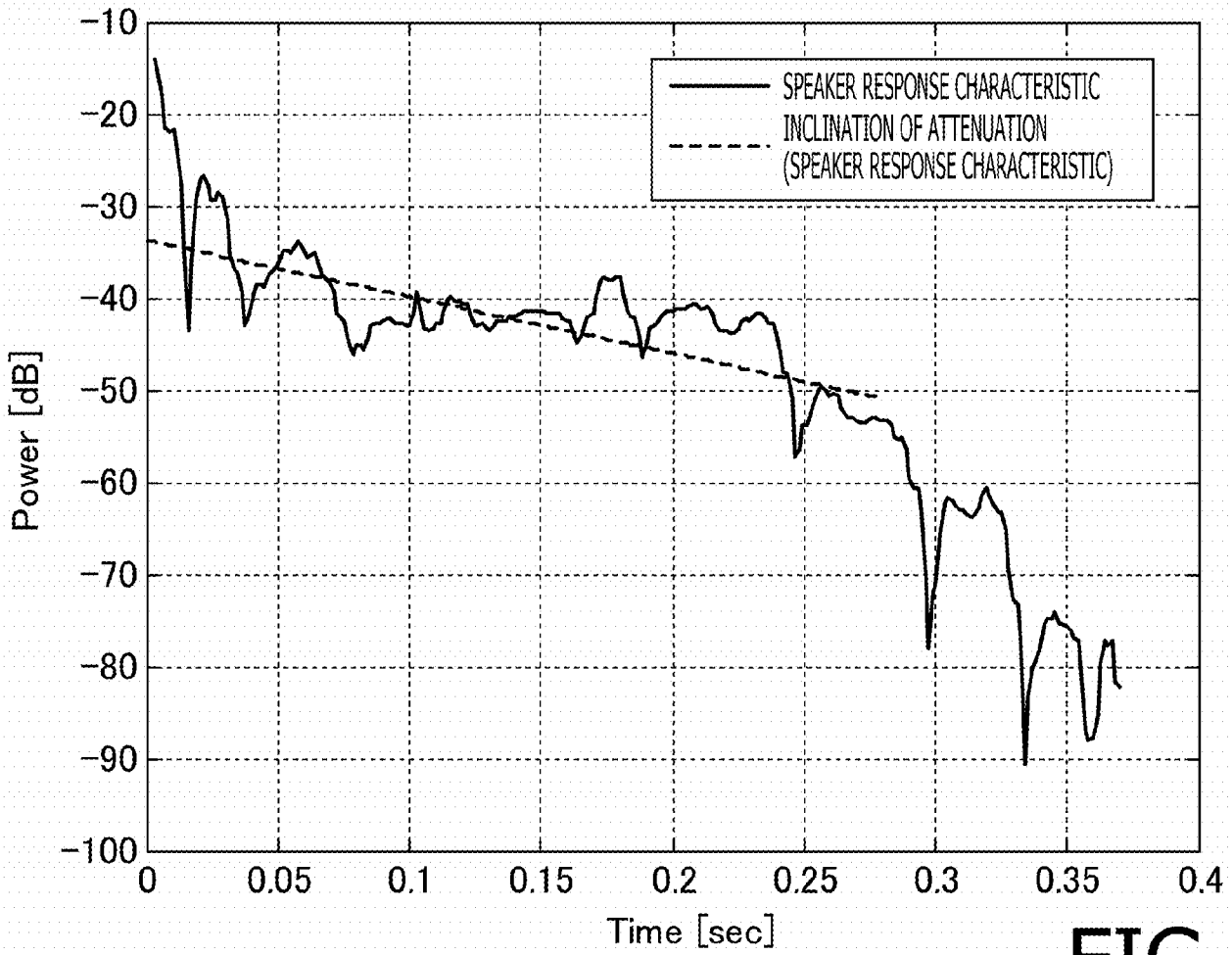
FIG. 5 is a diagram illustrating a speaker response characteristic at 100 Hz of the cumulative spectral decay shown in FIG. 2.

FIG. 5 is a diagram illustrating the characteristic at 100 Hz of the cumulative spectral decay (input level: 0 dB) shown in FIG. 2. In FIG. 5, the vertical axis represents the amplitude level (Power (unit: dB)), and the lateral axis represents time (Time (unit: sec)).

The inclination calculating unit 118B calculates an inclination of the speaker response characteristic at each input level. In the example shown in FIG. 5, regarding the frequency of 100 Hz, the inclination calculating unit 118B obtains the speaker response characteristic based on the cumulative spectral decay calculated by the cumulative spectral decay calculating unit 112, and calculates an approximation straight line of the obtained speaker response characteristic with a linear regression function. As shown in FIG. 5, the speaker distortion characteristic is attenuated with time. Therefore, the approximation straight line representing the speaker distortion characteristic has an inclination of a minus sign.

The following is an expression of an approximation straight line calculated by the inclination calculation unit 118B.

$$y=ax+b$$

where y=an amplitude level (an approximation)

a=an attenuation inclination of the speaker response characteristic x=reverberation time b=an amplitude level (an approximation) at 0 ms The reverberation time means a time elapsed from a time when a sound source stops outputting sound until a time when reverberation sound is attenuated to a certain gain.

Figure 6:
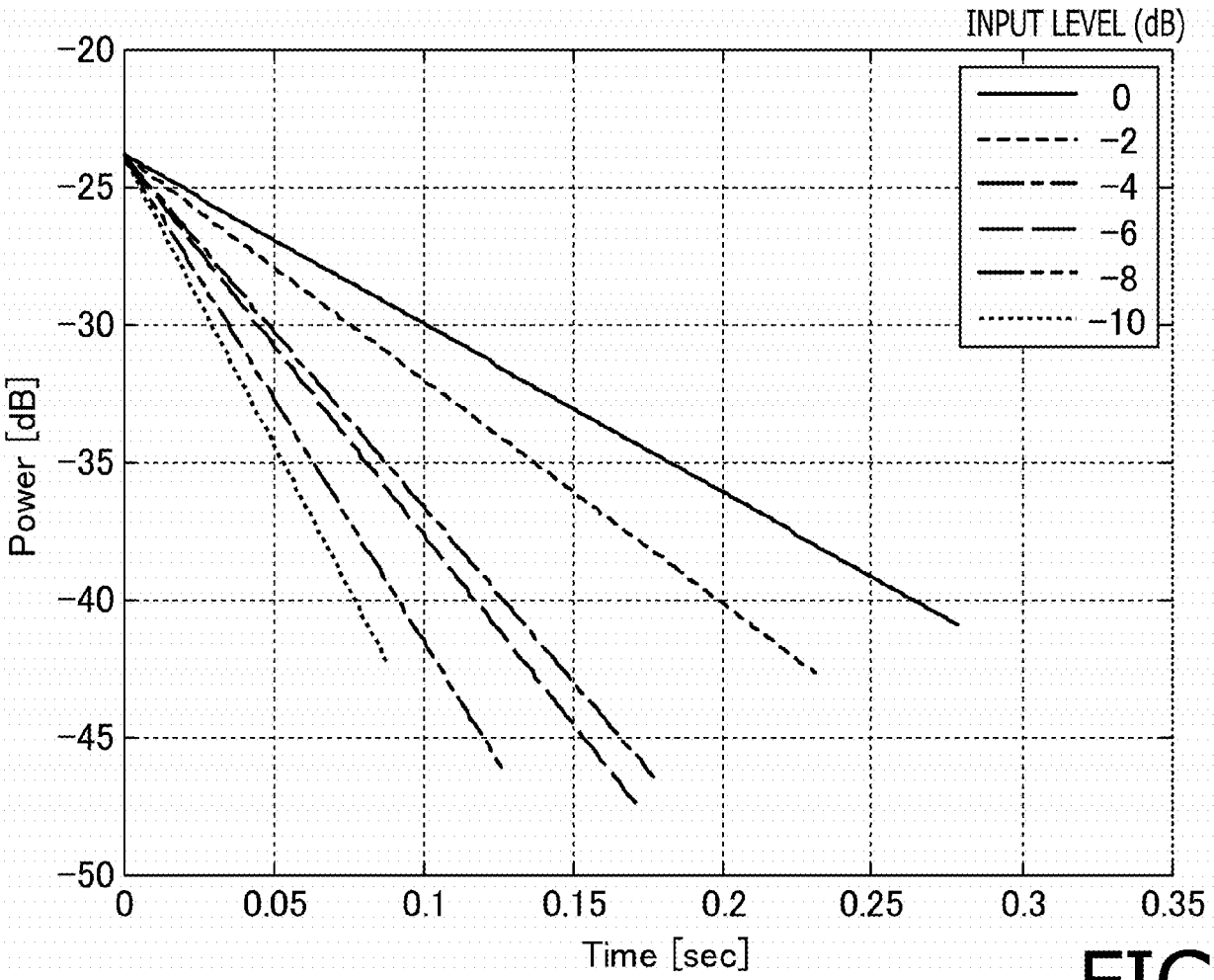
FIG. 6 is a diagram illustrating an attenuation inclination of the speaker response characteristic of 100 Hz at each input level.

FIG. 6 is a diagram illustrating the attenuation inclination a of the speaker response characteristic of 100 Hz at each input level (0 dB, −2 dB, −4 dB, −6 dB, −8 dB, −10 dB). In FIG. 6, the vertical axis represents the amplitude level (Power (unit: dB)), and the lateral axis represents time (Time (unit: sec)). For convenience of explanation, in FIG. 6, the input levels b at 0 ms are adjusted to the same level. Referring to FIG. 6, as the input level gets lower, the attenuation inclination a of the speaker characteristic gets larger in the minus direction and thereby the response of the speaker gets shorter on the time axis.

The control parameter calculating unit 118C calculates, for each of the resonant bands, a ratio R1 of the attenuation inclination a (hereafter, referred to as a "reference attenuation inclination a") of the speaker response characteristic at each input level with respect to the attenuation inclination a of the speaker response characteristic at the reference input level determined by the reference level setting unit 118A. The dB conversion unit 118D converts a linear scale value of the calculated ratio R1 into a decibel scale value, and obtains, as the control parameter (the control gain), the converted ratio R1 (the decibel scale value). The control gain thus obtained provides advantageous effects of suppressing occurrence of resonant sound by making the attenuation inclination a of the speaker response characteristic become equal to or approximately equal to the reference attenuation inclination a in accordance with the input level and thereby attenuating the speaker response characteristic.

Figure 7:
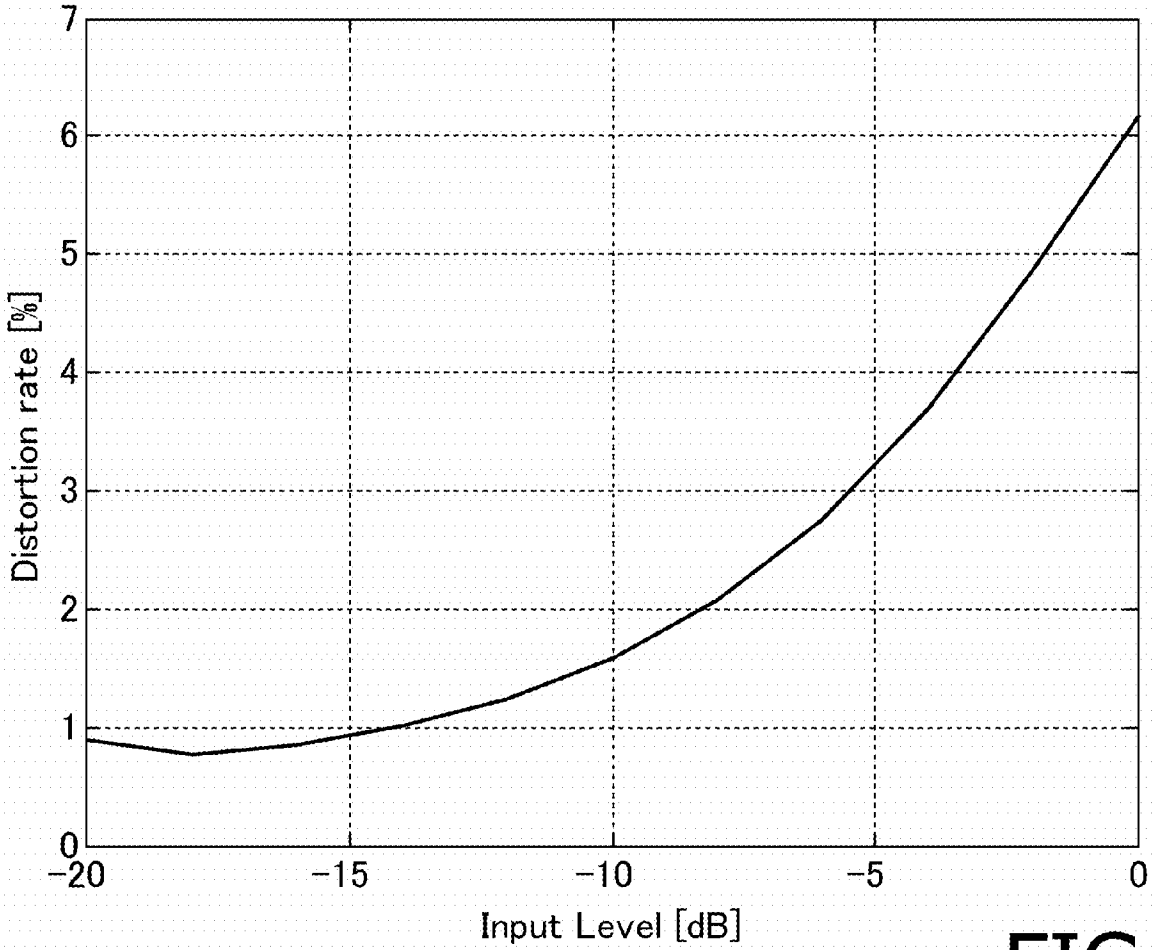
FIG. 7 is a diagram illustrating a speaker distortion rate with respect to an input level within the resonant band of 100 Hz.

FIG. 7 is a diagram illustrating the speaker distortion rate with respect to the input level within the resonant band of 100 Hz. In FIG. 7, the vertical axis represents the speaker distortion rate (Distortion Rate (unit: %)), and the lateral axis represents the input level (Input Level (unit: dB)). The graph shown in FIG. 7 can be obtained by extracting the speaker distortion rate at 100 Hz in FIG. 3. As shown in FIG. 7, in the frequency band of 100 Hz, the speaker distortion rate is lower when the input level is smaller than or equal to −10 dB, and rapidly becomes higher when the input level exceeds −10 dB.

Let us consider the case where the control gain with respect to the resonant band of 100 Hz is to be calculated. In this case, the control parameter calculating unit 118C calculates, for the resonant band of 100 Hz, the ratio R1 of the attenuation inclination a at each input level with respect to the reference attenuation inclination a at the reference input level (−10 dB) at which the speaker distortion rate becomes smaller than or equal to 1.5%. The ratio R1 is calculated as an increasing amount on the y-axis with respect to an increasing amount on the x-axis. i.e., Power (dB)/Time (sec). Referring to FIG. 6, the attenuation inclination a takes values of −62.96 (=−17 (dB)/0.27 (sec)) and −237.5 (=−19 (dB)/0.08 (sec) at the input levels of 0 dB and −10 dB, respectively. In this case, the ratio R1 is 0.265 (=−62.96/−237.5). By converting into the decibel scale value by the dB conversion unit 118D, the ratio R1 becomes −11.53 (dB). The value of −11.53 (dB) is the control gain with respect to the speaker response characteristic of 100 Hz at the input level of 0 dB. By executing similar calculations for the input levels other than 0 dB, the control gain at each input level can be obtained for the resonant band of 100 Hz.

By further executing similar calculations for the resonant bands other than 100 Hz, the control gain at each input level can be obtained for each of the resonant bands.

Figure 8:
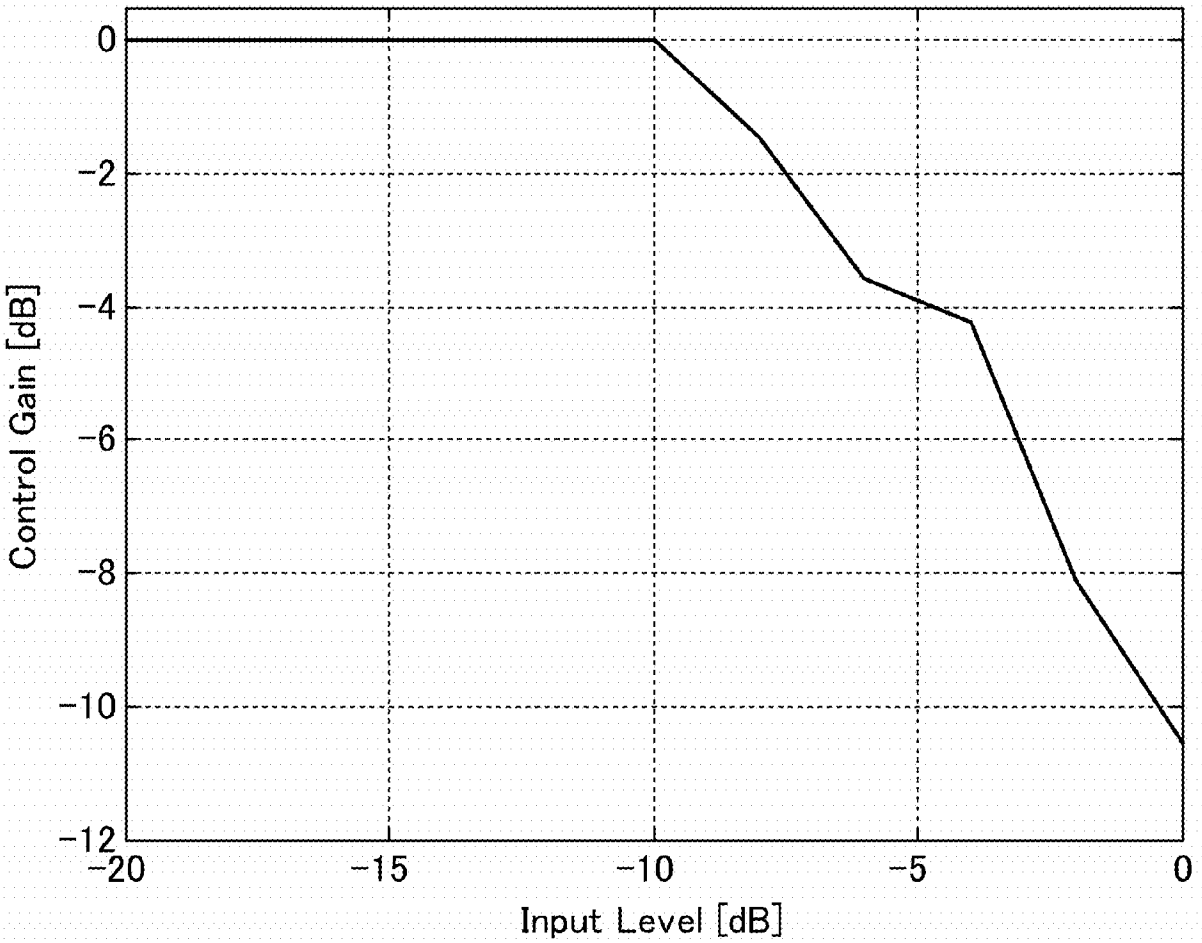
FIG. 8 is a diagram illustrating the control gain with respect to an input level in the frequency band of 100 Hz.

FIG. 8 is a diagram illustrating the control gain with respect to the input level in the frequency band of 100 Hz. In FIG. 8, the vertical axis represents the control gain (Control Gain (unit: dB)), and the lateral axis represents the input level (Input Level (unit: dB)). As shown in FIG. 8, when the input level is smaller than or equal to −10 dB, the speaker distortion rate is smaller than or equal to 1.5% and the reference input level is not determined. In this case, control using the control parameter is not performed. Accordingly, the control gain is 0 dB. When the input level exceeds −10 dB, the control gain gets larger in the minus direction as the input level becomes larger.

Figure 9:
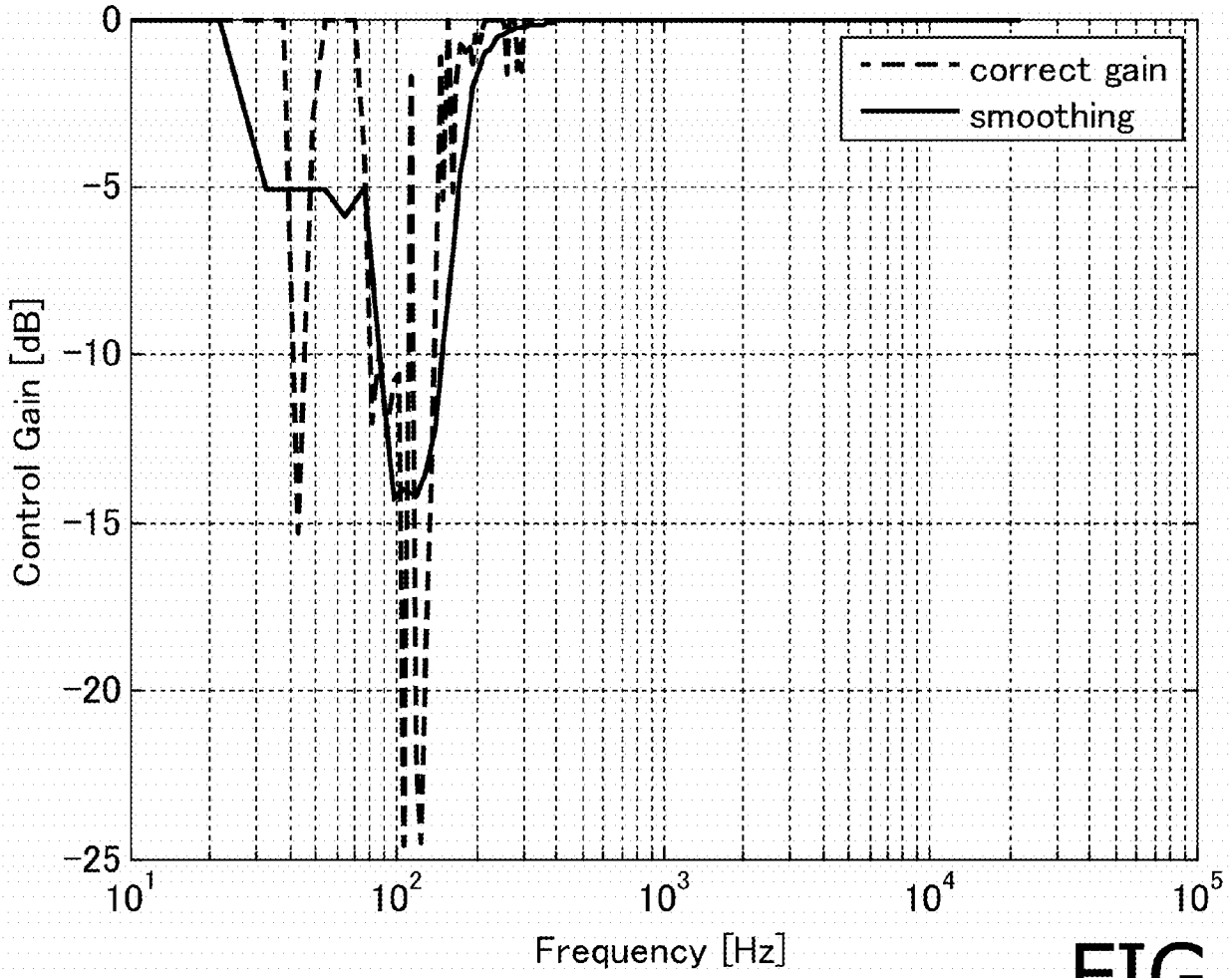
FIG. 9 is a diagram illustrating the control gain before and after executing a smoothing process when the input level is 0 dB.

The averaging processing unit 118E subjects the control gain output by the dB conversion unit 118D to a smoothing process executed as a logarithmic averaging process in the frequency domain. FIG. 9 is a diagram illustrating the control gain before and after executing the smoothing process when the input level is 0 dB. In FIG. 9, the vertical axis represents the control gain (Control Gain (unit: dB)), and the lateral axis represents the frequency (Frequency (unit: Hz)). In FIG. 9, a graph of "correct gain" indicates the control gain before executing the smoothing process, and a graph of "smoothing" indicates the control gain after executing the smoothing process. The control gain is an adjustment gain in the frequency domain. In the logarithmic averaging process, the number of control points defined when the Fourier transform length is 4096 samples (intervals of approximately 10.76 Hz=Sampling frequency 44100 Hz/Fourier transform length 4096 samples) is set to a half of the Fourier transform length, i.e., 2048 samples, and the control gain is smoothed by the band width of ⅓ octave which are known as frequency resolution of auditory sense.

Figure 10:
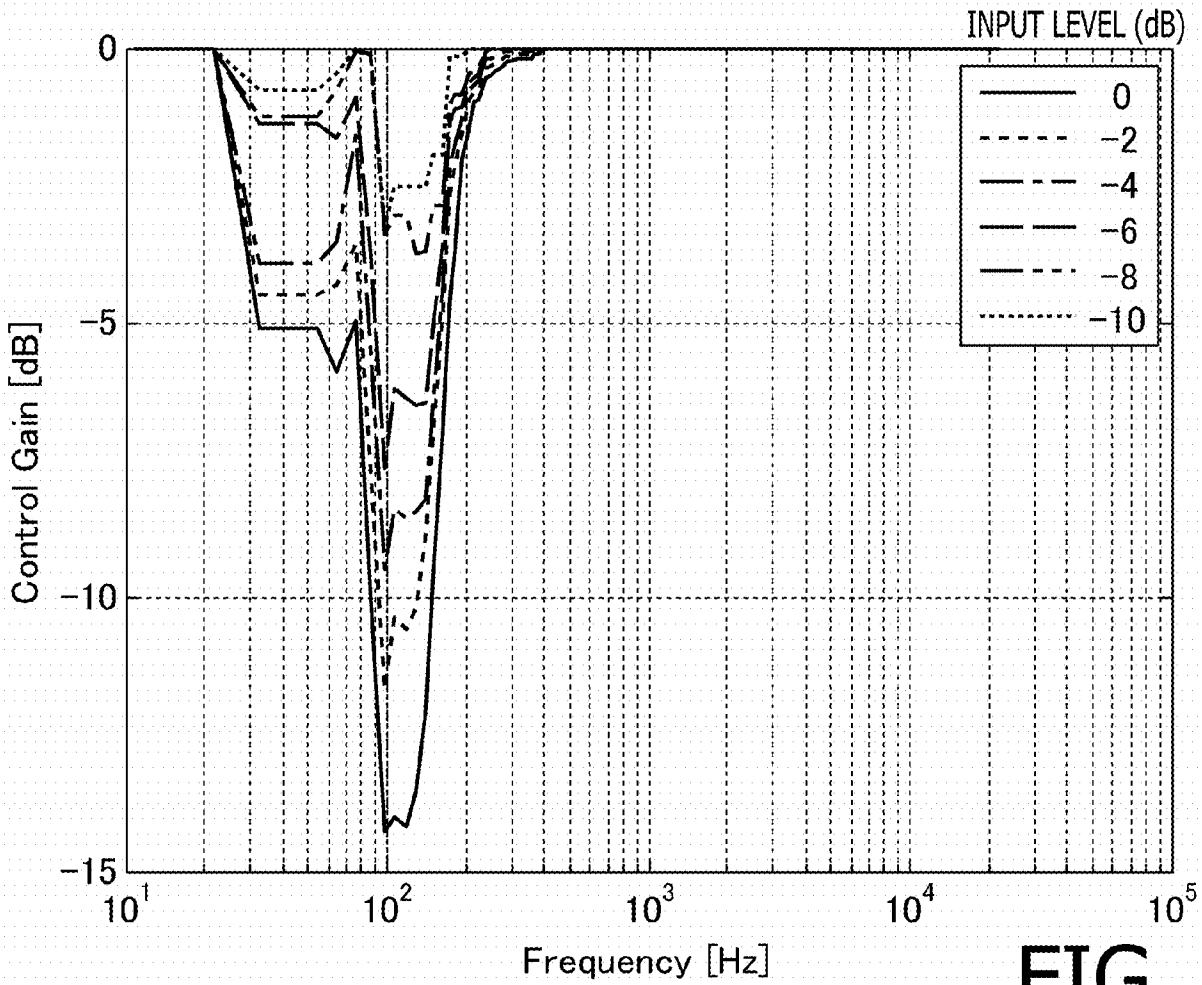
FIG. 10 is a diagram illustrating control gains of respective frequency bands for each of input levels.

FIG. 10 is a diagram illustrating the control gains of the respective frequency bands for each of the input levels. In FIG. 10, the vertical axis represents the control gain (Control Gain (unit: dB)), and the lateral axis represents the frequency (Frequency (unit: Hz)). As the input level becomes larger, the response of the speaker becomes long and thereby the resonant sound becomes greater. Therefore, as shown in FIG. 10, as the input level becomes larger, the control gain becomes larger in the minus direction.

The control parameter calculating unit 118C calculates a ratio R2 of the reverberation time of the speaker response characteristic at each input level with respect to the reverberation time (hereafter, referred to as a "reference reverberation time") of the speaker response characteristic at the reference input level determined by the reference input level setting unit 118A, and obtains, as the control parameter (the control time), the calculated ratio R2. The control tine thus obtained provides advantageous effects of preventing occurrence of resonant sound by suppressing the response characteristic of the speaker in the resonant band to be short on the time axis.

Let us consider the case where the control time for the resonant band of 100 Hz is calculated. In this case, the control parameter calculating unit 118C calculates, for the resonant band of 100 Hz, the ration R2 of the reverberation time at each input level with respect to the reference reverberation time at the reference input level (−10 dB) at which the speaker distortion rate is smaller than or equal to 1.5%. Referring to FIG. 6, when the input levels are 0 dB and −10 dB, the reverberation times are 0.2786 sec and 0.0885 sec, respectively. In this case, the ratio R2 (the control time) is 3.1475 sec (=0.2786/0.0885). By executing the similar calculation for the input levels other than 0 dB, the control times at respective input levels are obtained for the resonant band of 100 Hz. By further executing the similar calculation for the resonant bands other than 100 Hz, the control time at each input level is obtained for each of the resonant bands.

Figure 11:
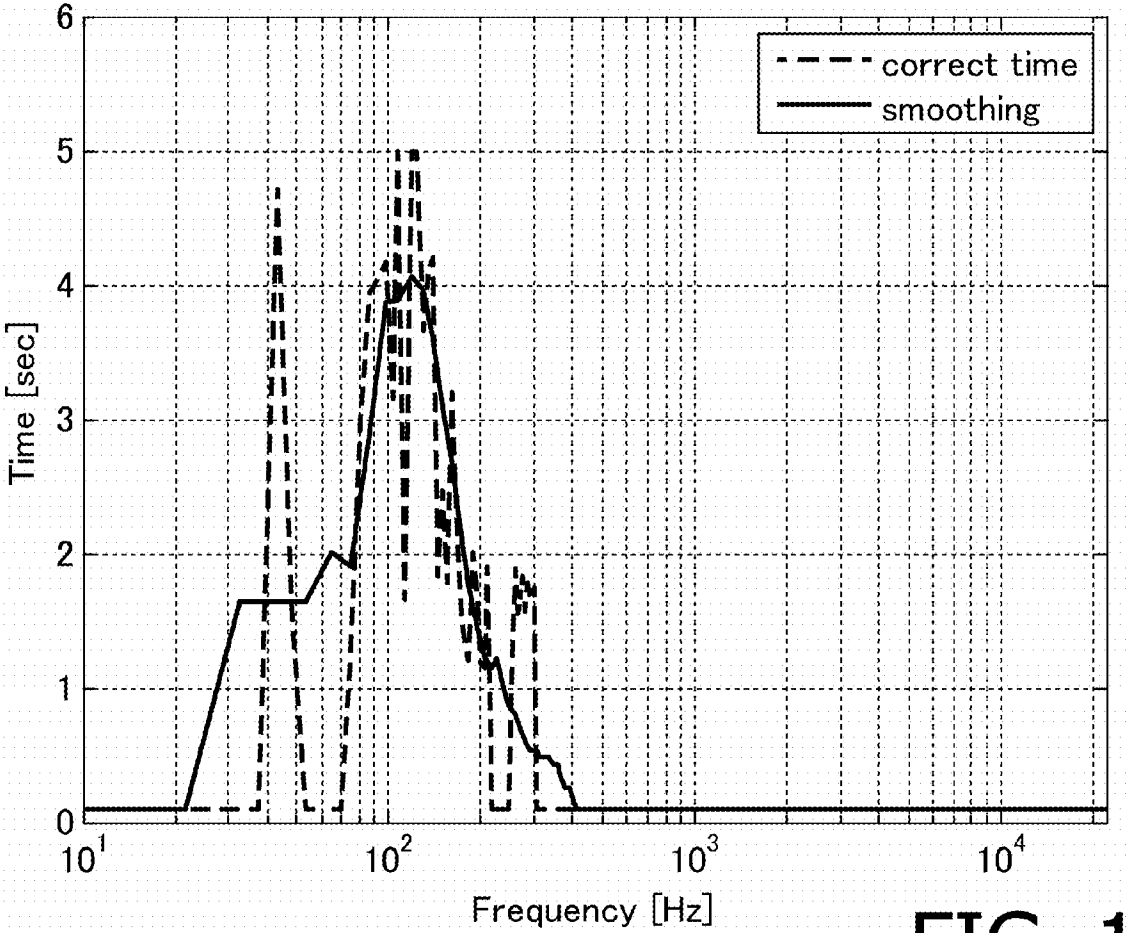
FIG. 11 is a diagram illustrating the control time before and after executing a smoothing process when the input level is 0 dB.

The averaging processing unit 118F subjects the control time output by the control parameter calculating unit 118C to the smoothing process executed as the logarithmic averaging process in the frequency domain. FIG. 11 is a diagram illustrating the control time before and after executing the smoothing process when the input level is 0 dB. In FIG. 11, the vertical axis represents the control time (Control Time (unit: sec)), and the lateral axis represents the frequency (Frequency (unit: Hz)). In FIG. 11, a graph of "correct time" indicates the control time before executing the smoothing process, and a graph of "smoothing" indicates the control gain after executing the smoothing process. In the logarithmic averaging process, the number of control points defined when the Fourier transform length is 4096 samples (intervals of approximately 10.76 Hz=Sampling frequency 44100 Hz/Fourier transform length 4096 samples) is set to a half of the Fourier transform length, i.e., 2048 samples, and the control time is smoothed by the band width of ⅓ octave which are known as frequency resolution of auditory sense. As shown in FIG. 11, for convenience, the control time other than the resonant band is set to be the minimum value (e.g., 0.1 sec).

(Speaker Response Control Using Control Parameter)

As shown in FIG. 1, the acoustic processing device 1 includes an FFT (Fast Fourier Transform) unit 120, a level detecting unit 122, a control parameter selecting unit 124, a frequency spectrum domain filtering unit 126 and an IFFT (Inverse Fast Fourier Transform) unit 128.

An audio signal reproduced by an audio signal reproducing device (not shown) is input to the FFT unit 120. The FFT unit 120 executes overlapping and weighting processing for the input audio signal, subjects the processed audio signal to the short-term Fourier transform to convert from the time domain to the frequency domain, and obtains the frequency spectrum of each of a real number and an imaginary number. Then, the FFT unit 120 converts the obtained frequency spectrum into an amplitude spectrum signal and a phase spectrum signal. The FFT unit 120 outputs the amplitude spectrum signal to the level detecting unit 122 and the frequency spectrum domain filtering unit 126, and outputs the phase spectrum signal to the IFFT unit 128.

The level detecting unit 122 converts the amplitude spectrum signal input from the FFT unit 120 into the decibel scale signal to detect the maximum value at each frequency band, and executes a holding process. The level detecting unit 122 outputs the signal which has been subjected to the holding process to the control parameter selecting unit 124.

The control parameter selecting unit 124 stores the control parameters (the control gain and the control time) at the respective input levels in each of the frequency bands generated in the control parameter generating unit 118. The control parameter selecting unit 124 selects the control gain (e.g., for the input level is 0 dB, the control gain after the smoothing process shown in FIG. 9) and the control time (e.g., for the input level of 0 dB, the control time after the smoothing process shown in FIG. 11) of each of the frequency bands corresponding to the input level of the audio signal, and outputs the selected control gain and the control time to the frequency spectrum domain filtering unit 126.

Figure 12:
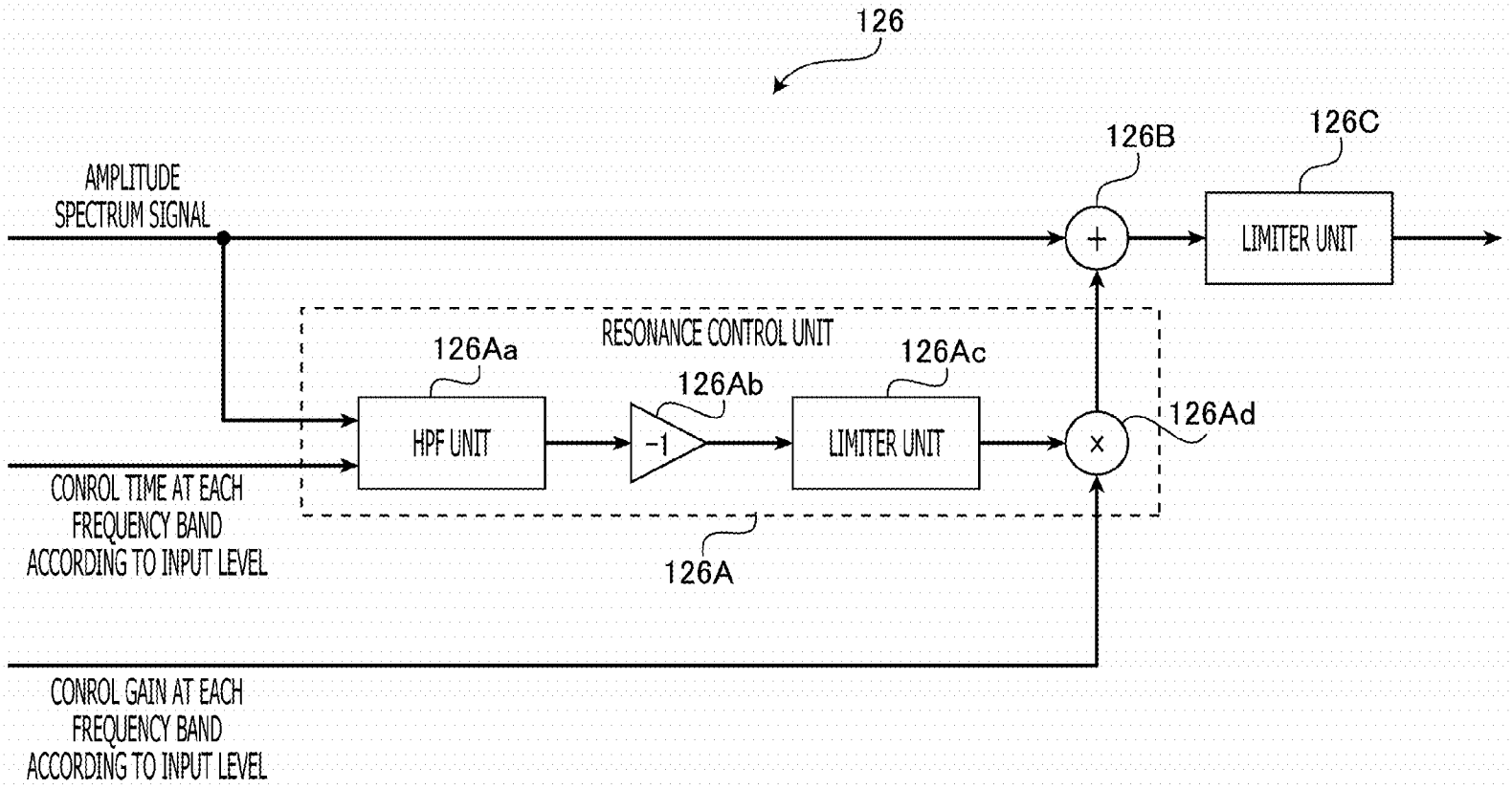
FIG. 12 is a block diagram illustrating a configuration of a frequency spectrum domain filtering unit provided in the acoustic processing device according to the embodiment of the invention.

FIG. 12 is a block diagram illustrating a configuration of the frequency spectrum domain filtering unit 126. As shown in FIG. 12, the frequency spectrum domain filtering unit 126 includes a resonance control unit 126A, an adder 126B and a limiter unit 126C. The frequency spectrum domain filtering unit 126 executes, for each amplitude spectrum, a filtering process, an amplitude limiting process and an amplitude weighting process by the control gain with respect to the audio signal (the amplitude spectrum signal) input from the FFT unit 120, but does not execute these processes with respect to the audio signal (the phase spectrum signal).

The resonance control unit 126A includes an HPF (High Pass Filter) unit 126Aa, an amplitude inverting unit 126Ab, a limiter unit 126Ac and a multiplier 126Ad.

To the HPF unit 126Aa, an amplitude spectrum signal is input from the FFT unit 120. Filtering coefficients of the HPF unit 126Aa are calculated in advance or when the filtering process is executed, using the control parameter (the control time) input from the control parameter selecting unit 124. The HPF unit 126Aa executes, for each of the amplitude spectrums, a high-pass filtering process, i.e., a differentiation process, based on the filtering coefficients calculated using the control parameter (the control time) for the amplitude spectrum input from the FFT unit 120.

The amplitude inverting unit 126Ab multiplies the amplitude spectrum subjected to the filtering process by the HPF unit 126Aa by −1 to invert the amplitude of the amplitude spectrum signal.

The limiter unit 126Ac limits the amplitude on the minus side of the amplitude spectrum signal of which the amplitude has been inverted to set the amplitude on the minus side to zero. As a result, a trailing component of the signal of each amplitude spectrum, i.e., a lingering sound (resonance) component, is detected.

The HPF unit 126Aa is a $1^{st}$-order Butterworth filter. As the value of the cut-off frequency set in the HPF unit 126Aa becomes larger, the control time of the resonance becomes shorter. On the other hand, as the value of the cut-off frequency set in the HPF unit 126Aa becomes smaller, the control time of the resonance becomes longer. By adjusting the cut-off frequency, the control time of the resonance based on the control parameter (the control time) is adjusted, and thereby the degree of suppression of the resonance (a degree of reduction of the speaker response characteristic) changes. It should be noted that the inverse of the cut-off frequency is the control time of the resonance. In this embodiment, the settable cut-off frequency range is 0.2 Hz to 10.0 Hz (the settable control time range: 0.1 sec to 5.0 sec).

The multiplier 126Ad executes the weighting (multiplication) for the resonance component of each amplitude spectrum signal detected by the limiter unit 126Ac, and outputs the weighted signal to the adder 126B. The weighting value for each amplitude spectrum signal is determined based on the control parameter (the control gain) of each frequency band input from the control parameter selecting unit 124.

The adder 126B synthesizes the original amplitude spectrum signal (the amplitude spectrum signal for which the acoustic process of the resonance component has not been executed and which is directly input from the FFT unit 120) and the amplitude spectrum signal (the amplitude spectrum signal for which the acoustic process of the resonance component has been executed) input from the adder 126Ad. The weighting value based on the control parameter (the control gain) is minus. The resonant band is suppressed to be short when the weighting value is minus. The adder 126B outputs the synthesized amplitude spectrum signal to the limiter unit 126C.

The limiter unit 126C limits the minus side of the synthesized amplitude spectrum signal (the amplitude spectrum signal for which the resonance component has been adjusted by the resonance control unit 126A) input from the adder 126B to zero so that the amplitude of the synthesized amplitude spectrum signal does not takes a minus value.

As described above, in the frequency spectrum domain filtering unit 126, control for the resonance component based on the control parameter (the control gain and the control time) is executed with respect to the amplitude spectrum signal of each frequency band input from the FFT unit 120. The amplitude spectrum signal for which suppressing of the resonance component has been performed is output from the limiter unit 126C to the IFFT unit 128. It should be noted that technology for suppressing the resonance component (adjustment of the lingering sound) can be referred to, for example, in Japanese Patent Provisional Publication No. 2013-190470A.

Based on the amplitude spectrum signal processed by the frequency spectrum domain filtering unit 126 and the phase spectrum signal input from the FFT unit 120, the IFFT unit 128 converts these signals into real and imaginary frequency spectrums. Then, the IFFT unit 128 executes weighting by a window function for the converted frequency spectrum, and converts the frequency spectrum from the frequency domain to the time domain by executing a short-time inverse Fourier transform process and overlapping addition. The audio signal converted to the time domain from the frequency domain is reproduced through the speaker 106.

In this embodiment, the resonance component is suppressed based on appropriate control parameters (the control gain and the control time) according to the input level of the audio signal reproduced by the audio signal reproducing device. As a result, for the band in which the speaker response characteristic is long, i.e., the resonance band (a band in which an attaching portion of the speaker 106 and peripheral parts of the speaker 106 are vibrated), the speaker response characteristic is suppressed to a short time on the time-axis, and thereby the resonant sound can be suitably suppressed without causing decrease of sound pressure. For components in which distortion by the frequency band or the input level is small and thereby resonant sound is not caused, suppressing of the speaker response characteristic based on the control parameter is not performed. Furthermore, according to the embodiment, in addition to the resonant sound, for voice or sound causing uncomfortable feeling by echoing long in a vehicle compartment, a lingering sound component thereof can be suitably suppressed. As a result, it becomes possible to enhance sound quality and articulation of sound even in a listening environment of a vehicle compartment.

(Example of Concrete Processing)

Figure 13:
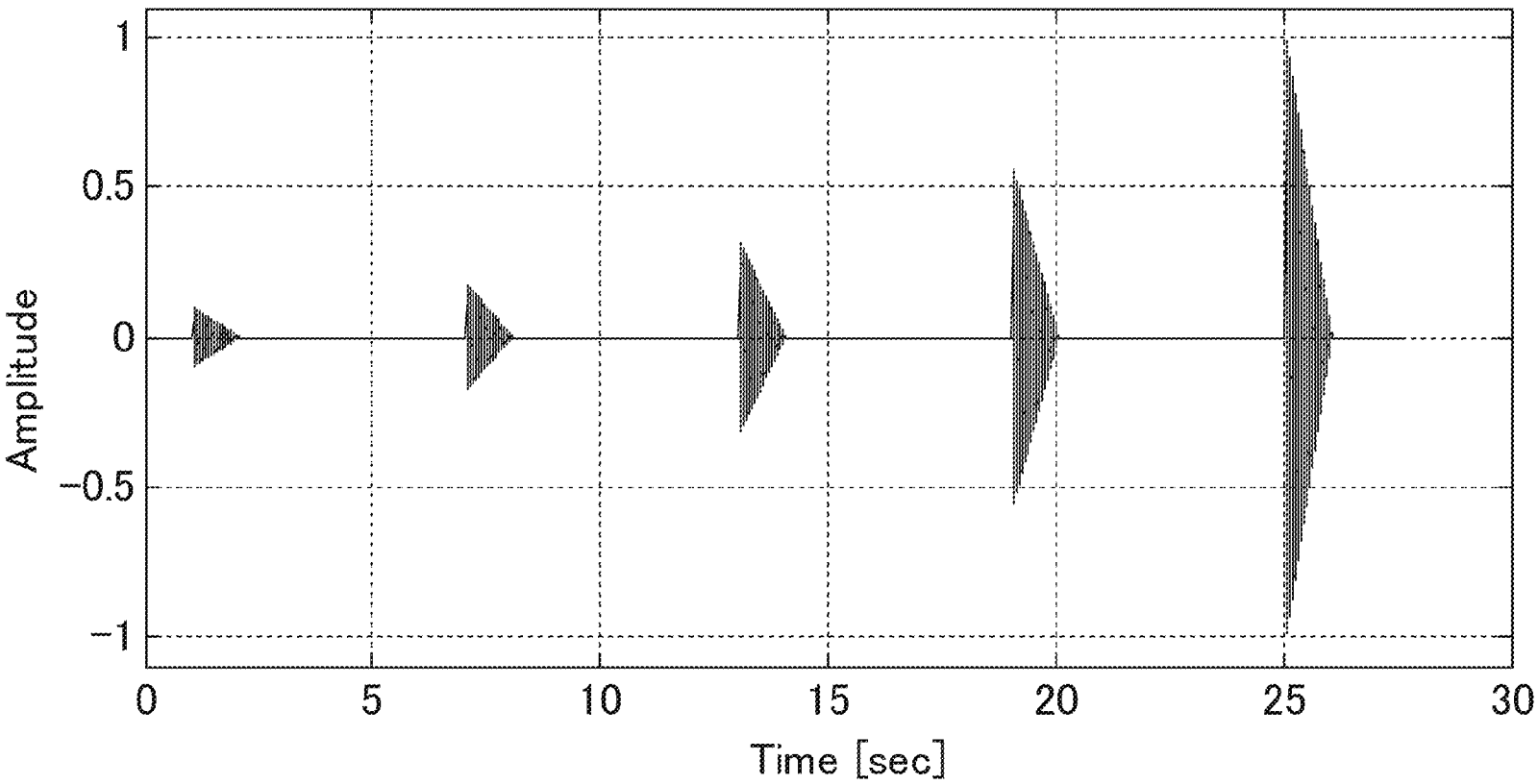
FIG. 13 is a diagram illustrating an audio signal input to an FFT unit provided in the acoustic processing device according to the embodiment of the invention.
Figure 14:
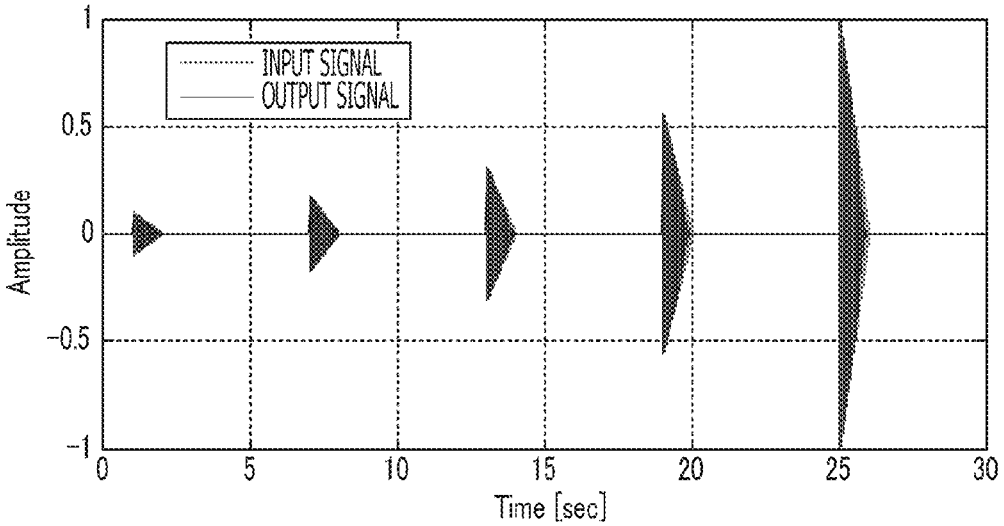
FIG. 14 illustrates diagrams of audio signals output from an IFFT unit provided in the acoustic processing device according to the embodiment of the invention.
Figure 14:
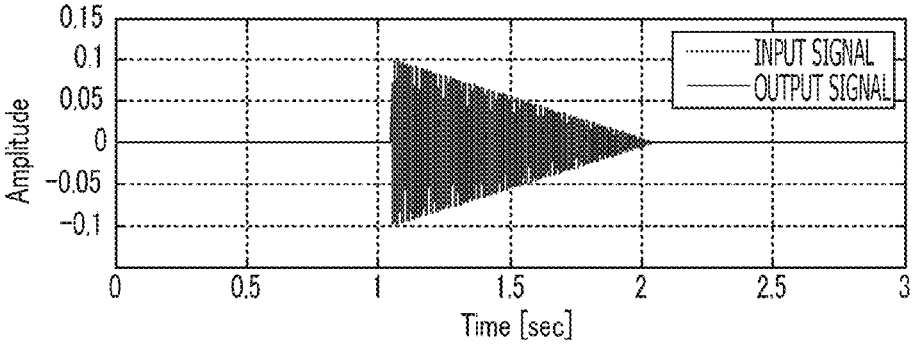
Figure 14:
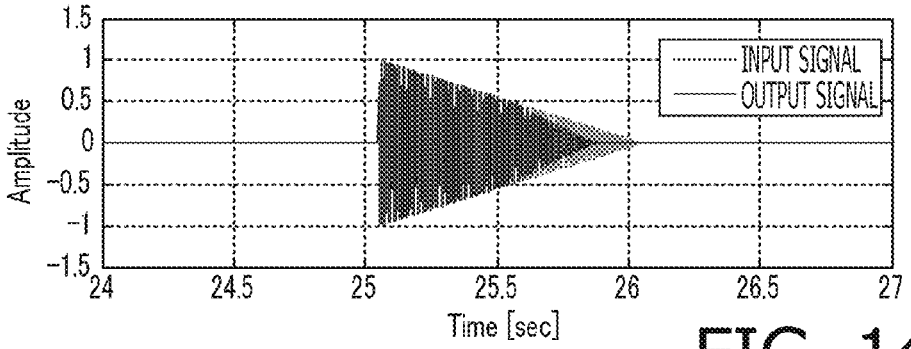

Hereafter, concrete processing examples by the acoustic processing device 1 according to the embodiment is explained with reference to FIGS. 13 to 15. FIG. 13 is a diagram illustrating an audio signal input to the FFT unit 120. FIGS. 14(*a*) to 14(*c*) are diagrams illustrating audio signals output from the IFFT unit 128. In each of FIG. 13 and FIGS. 14(*a*) to 14(*c*), the vertical axis represents the amplitude level (Amplitude (not having a unit because the amplitude level is normalized)), and the lateral axis represents time (Time (unit: sec)). It should be noted that the audio signal has a sampling frequency of 44.1 kHz, and the frequency component of 100 Hz. The FFT unit 120 has the Fourier transform length of 4096 samples, the overlapping length of 3.840 samples which is 15/16 of the Fourier transform length, a window function of Blackman, and the sampling frequency of the amplitude spectrum of 172 Hz (44,100/(4,096−3.840≈172).

As shown in FIG. 13, in the concrete processing example, sine wave pulse signals of 100 Hz which are gradually amplified (−20 dB, −15 dB, −10 dB, −5 dB, 0 dB) are input to the FFT unit 120. As a result, sine wave pulse signals shown in FIG. 14(*a*) are output from the IFFT unit 128.

In FIG. 14(*b*), for the audio signal at the input level of −20 dB, the waveform input to the FFT unit 120 and the waveform output from the IFFT unit 128 are overlaid. Further, in FIG. 14(*c*), for the audio signal at the input level of 0 dB, the waveform input to the FFT unit 120 and the waveform output from the IFFT unit 128 are overlaid. As shown in FIG. 14(*b*), when the input level is −20 dB (i.e., when the input level is low and no substantial resonance component exists), suppression of the resonance component based on the control parameters (the control gain and the control time) is not executed. Therefore, the input waveform and the output waveform are substantially equal to each other. On the other hand, it is understood that, as shown in FIG. 14(*c*), when the input level is 0 dB (when the input level is high and the resonant sound is caused), the resonance component is suppressed based on the control parameters (the control gain and the control time), and thereby the output waveform is suppressed to be shorter than the input waveform on the time axis.

Figure 15:
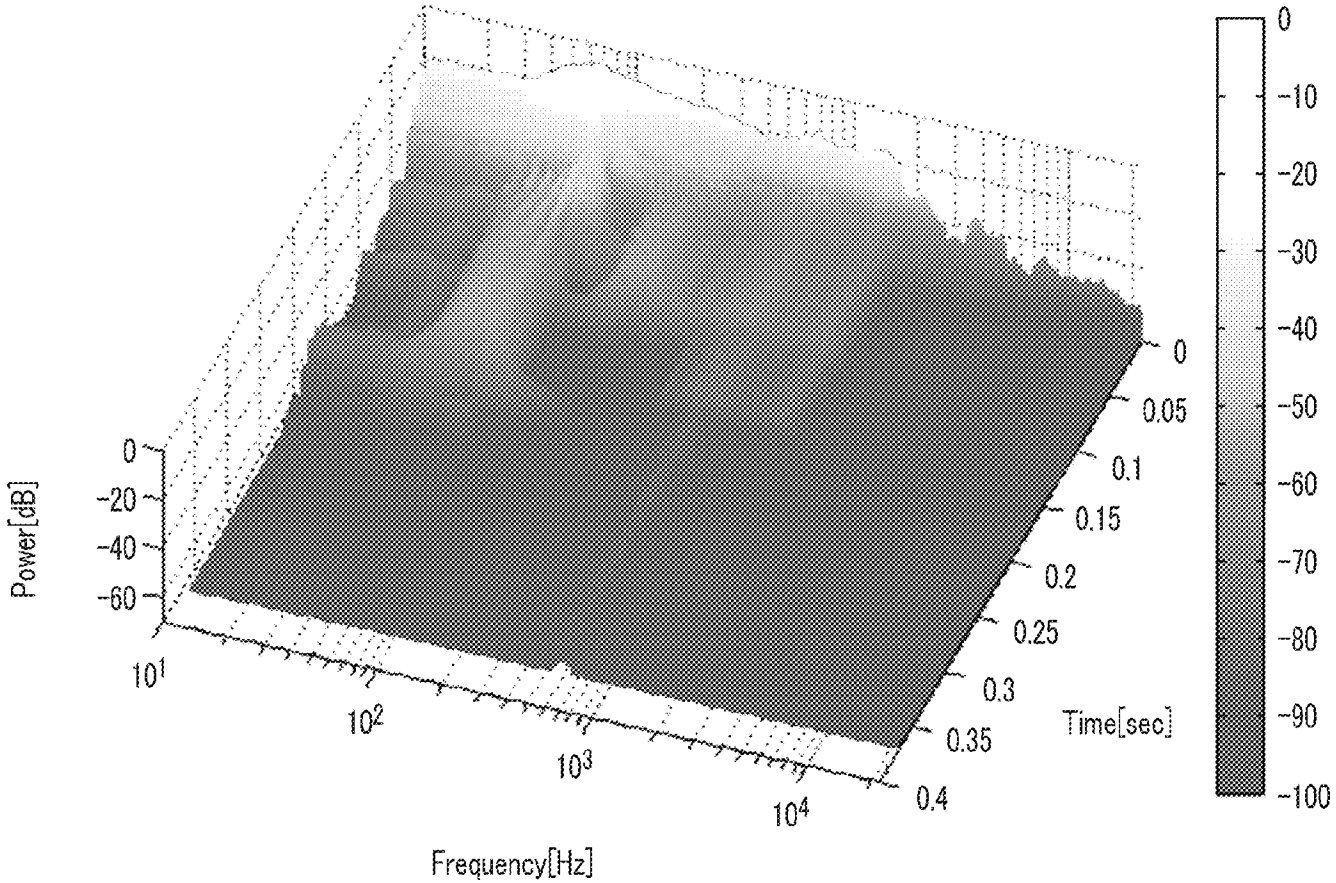
FIG. 15 is a diagram illustrating cumulative spectral decay obtained when the control parameters are applied to measured signal (TSP signal) at the input level of 0 dB for which the resonance component is suppressed.

FIG. 15 is a diagram illustrating the cumulative spectral decay obtained when the control parameters are applied to the measured signal (TSP signal) at the input level of 0 dB for which the resonance component is suppressed. In contrast to FIG. 15, the cumulative spectral decay shown in FIG. 2 is the one defined when the resonance components are not suppressed. By comparing FIG. 2 with FIG. 15, it is understood that the speaker response characteristic is suppressed to be short on the time axis without lowering the sound pressure (power (dB)) in the resonant band of 80 Hz to 100 Hz. As described above, according to the embodiment, resonance components of an audio signal is suppressed to be short on the time axis based on the control parameters (the control gain and the control time), and thereby it becomes possible to suitably suppress the resonant sound that would occur in the listening environment described in the embodiment.

The foregoing is the exemplary explanation about the embodiment of the invention. The invention is not limited to the above described embodiment, but can be varied in various ways within the scope of the invention. For example, examples and the like explicitly described in the specification or a combination of examples easily realized from the examples is also included in embodiments of the invention.

What is claimed is:

1. An acoustic processing device, comprising:

a resonant band detecting unit configured to detect a resonant band of sound output from a speaker based on a measurement result of a predetermined measurement signal reproduced through the speaker;

an analyzing unit configured to analyze the measurement result of the predetermined measurement signal;

a control parameter generating unit configured to generate a control parameter for controlling the resonant band detected by the resonant band detecting unit based on an analysis result by the analyzing unit; and an audio signal controlling unit configured to control an audio signal input from a predetermined audio signal reproducing device based on the control parameter generated by the control parameter generating unit such that a resonant band component of reproduced sound of the audio signal is suppressed on a time axis; wherein:

the predetermined measurement signal includes a predetermined sweep signal; and the resonant band detecting unit is configured to:

detect a speaker distortion characteristic using a reference signal of the predetermined sweep signal and the measurement result of the predetermined sweep signal; and detect the resonant band based on the detected speaker distortion characteristic;

the control parameter includes a control gain for controlling a gain of the resonant band and a control time for controlling a reverberation time of the resonant band;

wherein the resonant band detecting unit is configured to detect the speaker distortion characteristic using the reference signal of the predetermined sweep signal and the measurement result of the predetermined sweep signal for each input level;

wherein the control parameter generating unit is configured to:

set, for each resonant band, a predetermined reference input level based on the speaker distortion characteristic of each input level; and calculate, for each resonant band, the control gain based on a ratio between an attenuation inclination of a speaker response characteristic at an input level of the predetermined measurement signal and an attenuation inclination of a speaker response characteristic at the reference input level.

2. The acoustic processing device according to claim 1, wherein:

the predetermined measurement signal includes an TSP (Time Stretched Pulse) signal; and the analyzing unit is configured to calculate an impulse response of a listening environment using a reference signal of the TSP signal and the measurement result of the TSP signal, and to analyze the measurement result based on the calculated impulse response.

3. The acoustic processing device according to claim 1, wherein the control parameter generating unit is configured to calculate, for each resonant band, the control time based on a ratio between the reverberation time at the input level of the predetermined measurement signal and the reverberation time at the reference input level.

4. An acoustic processing device, comprising:

a resonant band detecting unit configured to detect a resonant band of sound output from a speaker based on a measurement result of a predetermined measurement signal reproduced through the speaker;

an analyzing unit configured to analyze the measurement result of the predetermined measurement signal of each input level;

a control parameter generating unit configured to generate a control parameter for controlling the resonant band detected by the resonant band detecting unit based on an analysis result by the analyzing unit, the control parameter being generated for each input level of the predetermined measurement signal;

a control parameter storing unit that stores the control parameter generated for each input level by the control parameter generating unit; and an audio signal controlling unit configured to select, from the control parameter storing unit, the control parameter corresponding to an input level of an audio signal input from a predetermined audio signal reproducing device and to control the audio signal based on the selected control parameter such that a resonant band component of reproduced sound of the audio signal is suppressed on a time axis; wherein:

the predetermined measurement signal includes a predetermined sweep signal; and the resonant band detecting unit is configured to:

detect a speaker distortion characteristic using a reference signal of the predetermined sweep signal and the measurement result of the predetermined sweep signal; and detect the resonant band based on the detected speaker distortion characteristic;

the control parameter includes a control gain for controlling a gain of the resonant band and a control time for controlling a reverberation time of the resonant band;

wherein the resonant band detecting unit is configured to detect the speaker distortion characteristic using the reference signal of the predetermined sweep signal and the measurement result of the predetermined sweep signal for each input level;

wherein the control parameter generating unit is configured to:

set, for each resonant band, a predetermined reference input level based on the speaker distortion characteristic of each input level; and calculate, for each resonant band, the control gain based on a ratio between an attenuation inclination of a speaker response characteristic at an input level of the predetermined measurement signal and an attenuation inclination of a speaker response characteristic at the reference input level.

5. An acoustic processing method, comprising:

detecting a resonant band of sound output from a speaker based on a measurement result of a predetermined measurement signal reproduced through the speaker;

analyzing the measurement result of the predetermined measurement signal;

generating a control parameter for controlling the detected resonant band based on an analysis result by the analyzing; and controlling an audio signal input from a predetermined audio signal reproducing device based on the generated control parameter such that a resonant band component of reproduced sound of the audio signal is suppressed on a time axis;

wherein:

the predetermined measurement signal includes a predetermined sweep signal; and in the detecting the resonant band, a speaker distortion characteristic is detected using a reference signal of the predetermined sweep signal and the measurement result of the predetermined sweep signal, and the resonant band is detected based on the detected speaker distortion characteristic;

wherein:

the control parameter includes a control gain for controlling a gain of the resonant band and a control time for controlling a reverberation time of the resonant band;

in the detecting the resonant band, the speaker distortion characteristic is detected using the reference signal of the predetermined sweep signal and the measurement result of the predetermined sweep signal for each input level; and in the generating the control parameter, a predetermined reference input level is set, for each resonant band, based on the speaker distortion characteristic of each input level, and the control gain is calculated, for each resonant band, based on a ratio between an attenuation inclination of a speaker response characteristic at an input level of the predetermined measurement signal and an attenuation inclination of a speaker response characteristic at the reference input level.

6. The acoustic processing method according to claim 5, wherein:

the predetermined measurement signal includes an TSP (Time Stretched Pulse) signal; and in the analyzing, an impulse response of a listening environment is calculated using a reference signal of the TSP signal and the measurement result of the TSP signal, and the measurement result is analyzed based on the calculated impulse response.

7. The acoustic processing method according to claim 5, wherein, in the generating the control parameter, the control time is calculated, for each resonant band, based on a ratio between the reverberation time at the input level of the predetermined measurement signal and the reverberation time at the reference input level.

8. An acoustic processing method, comprising:

detecting a resonant band of sound output from a speaker based on a measurement result of a predetermined measurement signal reproduced through the speaker;

analyzing the measurement result of the predetermined measurement signal of each input level;

generating a control parameter for controlling the detected resonant band based on an analysis result by the analyzing, the control parameter being generated for each input level of the predetermined measurement signal;

storing, in a predetermined storage medium, the control parameter generated for each input level; and selecting, from control parameters stored in the predetermined storage medium, a control parameter corresponding to an input level of an audio signal input from a predetermined audio signal reproducing device and controlling the audio signal based on the selected control parameter such that a resonant band component of reproduced sound of the audio signal is suppressed on a time axis; wherein:

the predetermined measurement signal includes a predetermined sweep signal; and in the detecting the resonant band, a speaker distortion characteristic is detected using a reference signal of the predetermined sweep signal and the measurement result of the predetermined sweep signal, and the resonant band is detected based on the detected speaker distortion characteristic;

wherein the control parameter includes a control gain for controlling a gain of the resonant band and a control time for controlling a reverberation time of the resonant band;

in the detecting the resonant band, the speaker distortion characteristic is detected using the reference signal of the predetermined sweep signal and a measurement result of the predetermined sweep signal for each input level; and in the generating the control parameter, a predetermined reference input level is set, for each resonant band, based on the speaker distortion characteristic of each input level, and the control gain is calculated, for each resonant band, based on a ratio between an attenuation inclination of a speaker response characteristic at an input level of the predetermined measurement signal and an attenuation inclination of a speaker response characteristic at the reference input level.

9. A non-transitory computer readable medium having computer readable instruction stored thereon, which, when executed by a processor of an acoustic processing device configures the processor to perform:

detecting a resonant band of sound output from a speaker based on a measurement result of a predetermined measurement signal reproduced through the speaker;

analyzing the measurement result of the predetermined measurement signal;

generating a control parameter for controlling the detected resonant band based on an analysis result by the analyzing; and controlling an audio signal input from a predetermined audio signal reproducing device based on the generated control parameter such that a resonant band component of reproduced sound of the audio signal is suppressed on a time axis;

wherein:

the predetermined measurement signal includes a predetermined sweep signal; and in the detecting the resonant band, a speaker distortion characteristic is detected using a reference signal of the predetermined sweep signal and the measurement result of the predetermined sweep signal, and the resonant band is detected based on the detected speaker distortion characteristic;

wherein:

the control parameter includes a control gain for controlling a gain of the resonant band and a control time for controlling a reverberation time of the resonant band;

in the detecting the resonant band, the speaker distortion characteristic is detected using the reference signal of the predetermined sweep signal and the measurement result of the predetermined sweep signal for each input level; and in the generating the control parameter, a predetermined reference input level is set, for each resonant band, based on the speaker distortion characteristic of each input level, and the control gain is calculated, for each resonant band, based on a ratio between an attenuation inclination of a speaker response characteristic at an input level of the predetermined measurement signal and an attenuation inclination of a speaker response characteristic at the reference input level.

10. A non-transitory computer readable medium having computer readable instruction stored thereon, which, when executed by a processor of an acoustic processing device configures the processor to perform:

detecting a resonant band of sound output from a speaker based on a measurement result of a predetermined measurement signal reproduced through the speaker;

analyzing the measurement result of the predetermined measurement signal of each input level;

generating a control parameter for controlling the detected resonant band based on an analysis result by the analyzing, the control parameter being generated for each input level of the predetermined measurement signal;

storing, in a predetermined storage medium, the control parameter generated for each input level; and selecting, from control parameters stored in the predetermined storage medium, the control parameter corresponding to an input level of an audio signal input from a predetermined audio signal reproducing device and controlling the audio signal based on the selected control parameter such that a resonant band component of reproduced sound of the audio signal is suppressed on a time axis; wherein:

the predetermined measurement signal includes a predetermined sweep signal; and in the detecting the resonant band, a speaker distortion characteristic is detected using a reference signal of the predetermined sweep signal and a measurement result of the predetermined sweep signal, and the resonant band is detected based on the detected speaker distortion characteristic;

wherein the control parameter includes a control gain for controlling a gain of the resonant band and a control time for controlling a reverberation time of the resonant band;

in the detecting the resonant band, the speaker distortion characteristic is detected using the reference signal of the predetermined sweep signal and the measurement result of the predetermined sweep signal for each input level; and in the generating the control parameter, a predetermined reference input level is set, for each resonant band, based on the speaker distortion characteristic of each input level, and the control gain is calculated, for each resonant band, based on a ratio between an attenuation inclination of a speaker response characteristic at an input level of the predetermined measurement signal and an attenuation inclination of a speaker response characteristic at the reference input level.

* * * * *